United States Patent [19]

Lyons

[11] 4,099,481

[45] Jul. 11, 1978

[54] APPARATUS FOR APPLYING METAL COATINGS TO A METAL SUBSTRATE

[75] Inventor: John E. Lyons, Levittown, N.Y.

[73] Assignee: Eutectic Corporation, Flushing, N.Y.

[21] Appl. No.: 728,202

[22] Filed: Sep. 30, 1976

[51] Int. Cl.[2] ..... B05B 13/04

[52] U.S. Cl. ..... 118/8; 118/312; 118/321; 239/80; 427/423

[58] Field of Search ..... 118/5, 8, 47, 302, 312, 118/321; 427/34, 423; 239/80, 85, 131, DIG. 2

[56] References Cited

U.S. PATENT DOCUMENTS

| | | | |
|---|---|---|---|
| 1,978,415 | 10/1934 | Collins | 118/321 X |
| 2,424,418 | 7/1947 | Rory | 118/321 |
| 2,786,779 | 3/1957 | Long et al. | 427/423 |
| 3,096,199 | 2/1963 | Lamb | 118/47 X |
| 3,226,028 | 12/1965 | Schilling | 239/1 |
| 3,312,566 | 4/1967 | Winzeler et al. | 427/34 |
| 3,397,732 | 8/1968 | Howell, Jr. | 118/321 X |
| 3,527,662 | 9/1970 | Elsworth | 118/5 X |
| 3,741,792 | 6/1973 | Peck et al. | 427/423 X |
| 3,971,336 | 7/1976 | Allen et al. | 118/8 |

*Primary Examiner*—Mervin Stein

*Attorney, Agent, or Firm*—Hopgood, Calimafde, Kalil, Blaustein & Lieberman

[57] ABSTRACT

The apparatus of the invention employs a gas torch which has the feature of selective addition of metal powder to the gas flow. In use, the torch is caused to make a continuous succession of traverses of a workpiece region for preheating purposes and then, without interrupting the continuous operation of either the torch or the traversing cycles, a controlled flow of metal powder is caused to enter the torch flow, enabling the bonding and progressive building of a metal coat to desired thickness. In the embodiments described, first and second different metal powders are thus successively coated to the substrate without interrupting the continuous operation. Different embodiments are described in the particular context of applying uniform circumferential coatings to a cylindrical workpiece such as a shaft.

24 Claims, 6 Drawing Figures

A
B
101'
101
N.C.
N.O.
103
106
TIMER (ABRASIVE CYCLE)
102'
102
104
DELAY MEANS
105
95
V
97
98
ABRASIVE GRIT
96
96'
10
99'
99
100
TO DRIVE CONNECTION C 111
112
113'
113
110
115
114
25
25'
22'
22
21
21'

42
43
45
41
45'
44
10'
121
121'
40
44'
23
126
122
122'
124
128
123
123'
125
127
39
120
D
26
22'
b
d
a
21'
21
22
c
TRAVERSE SPAN
27
OXYGEN
ACETYLENE
POWDER "A" AIR
POWDER "B" AIR

APPARATUS FOR APPLYING METAL COATINGS TO A METAL SUBSTRATE

The invention relates to apparatus for applying metal coatings to metal substrates and is in particular concerned with gas-torch techniques wherein metal powder is deposited.

Prior techniques for the gas-torch application of metal coatings to metal substrates have involved hand-held devices requiring relatively great skill in manipulation, if acceptable bonding and outer-coat quality are to be achieved. The manipulation involves use of different torches, each for its particular purpose. As a practical matter, there is always a degree of uncertainty as to just how reliable the coating will be in use, so that testing procedures are costly and relatively elaborate, depending upon the degree of assurance desired.

It is therefore an object of the invention to provide an improved means for gas-torch application of metal coatings to metal substrates.

It is a specific object to meet the above object with virtual certainty of superior-quality coatings at all times.

It is another specific object to meet the above objects to a degree permitting the substantial reduction of testing procedures.

A further specific object is to provide an improved means of the character indicated whereby a predetermined metal coating may be applied to a given substrate, with complete reproducibility of a metal coating of precisely the same high quality and thickness, from one workpiece to the next, in a succession of similar workpieces to be treated.

A general object is to achieve the foregoing objects at substantial savings of expense for materials and labor, in both coating and testing operations.

Other objects and various further features of novelty and invention will be pointed out or will occur to those skilled in the art from a reading of the following specification in conjunction with the accompanying drawings. In said drawings, which show, for illustrative purposes only, preferred embodiments of the invention:

Figure 1:
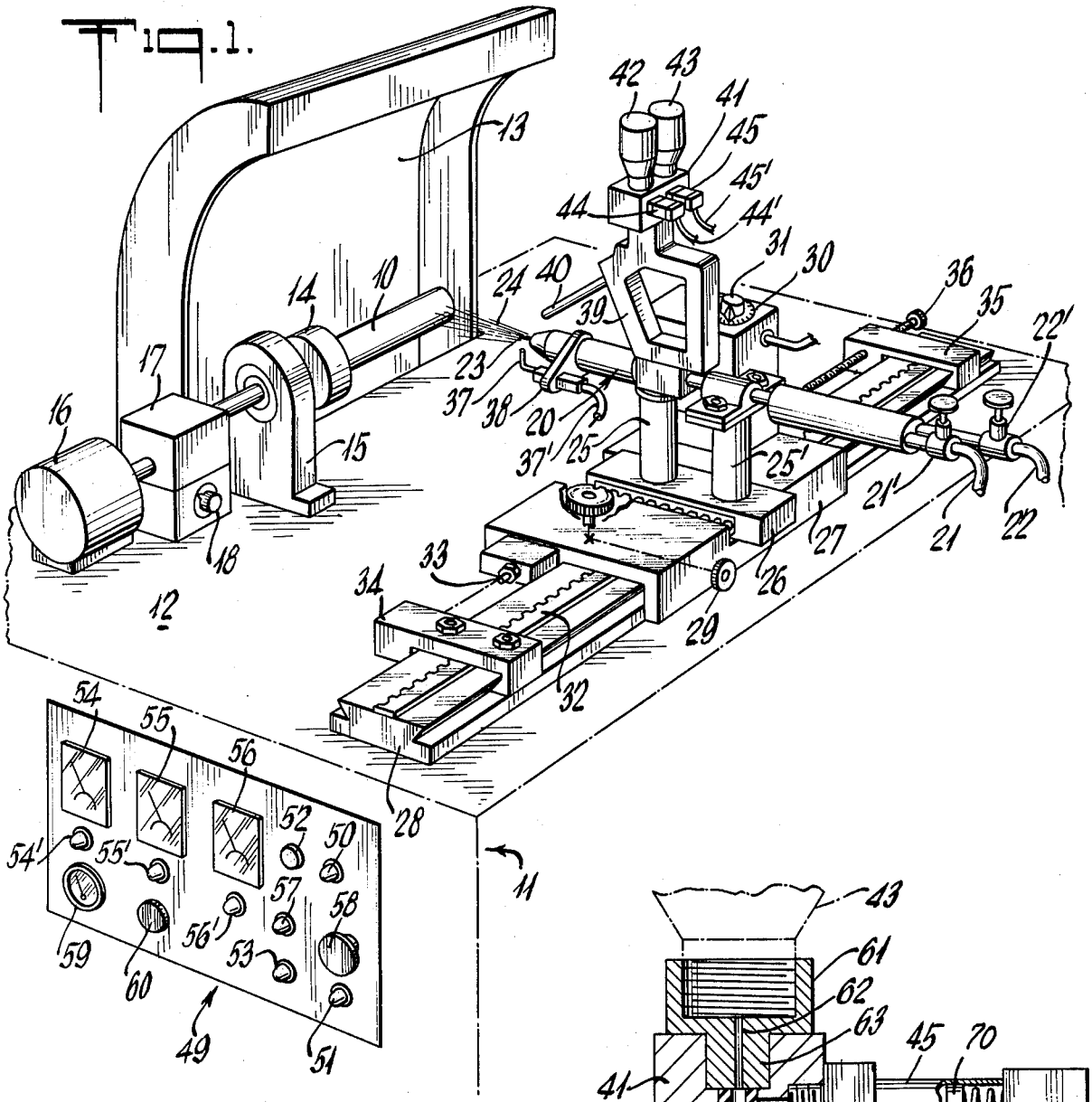
FIG. 1 is a simplified view in perspective of apparatus of the invention, shown in application to a cylindrical workpiece.

In FIG. 1, the invention is shown in application to an automatic machine for operation upon a cylindrical metal workpiece 10, such as a shaft, to be coated with a uniform circumferentially continuous metal layer, along a given axial region of the shaft length. The machine base or frame may be a table or console 11, with most of the mechanical operations performed on the top horizontal surface 12. A hood 13 behind the working region will be understood to be part of a suitable system for the safe and clean extraction of exhaust products, both solid and gaseous. The workpiece is subjected to a continuous rotation, being removably mounted to a chuck 14 supported in suitable bearings in a pedestal 15 mounted to surface 12. A motor 16 and reduction-gear mechanism 17 are also mounted to surface 12 and impart steady workpiece rotation at desired speed selected as by means 18 forming part of the gear mechanism 17.

An elongate gas torch 20 is shown with independent fuel-supply connections 21–22 at one end, as for acetylene and oxygen, respectively, and a nozzle 23 at the forward end directs a discharge 24 of hot torch-flow products with direct impingement upon a local region of the workpiece 10. Torch 20 is supported in horizontal orientation by spaced pedestals 25–25' on a cross slide 26 guided in transverse ways in a main or traverse slide 27. The main slide 27 is shown riding an elongate guide strip 28 secured to surface 12 and parallel to the axis of workpiece rotation. Radially offsetting adjustment of the torch nozzle with respect to the workpiece 10 is available at a manual knob 29 for rack-and-pinion positioning of the cross slide 26 with respect to the main slide 27. The main slide 27 is self-propelled by electric motor and control means contained in a unitary assembly 30 carried by slide 27, provision being made at 31 for selective adjustment of traverse speed; the traverse drive at 30 will be understood to include a pinion output (not shown) in constant mesh with an elongate rack 32 carried by or forming part of the guide strip 28. The traverse drive system further includes limit switches (as at 33) mounted to the respective longitudinal ends of slide 27; each of these limit switches coacts with an abutment stop adjustably clamped to the guide strip 28. The nearby or left-margin limit switch 33 is shown offset from but poised for interception by a left-margin stop 34, and a distant or right-margin similar limit switch (not shown in FIG. 1, but identified 33' in FIG. 3) will be understood to be poised for coaction with a similar right-margin stop 35, which is shown with an adjustable bolt 36 whereby ready right-margin coaction with the right-margin limit switch may be selected, as for accommodation of traverse span to workpiece length. The function of the stops 34–35, in cooperation with their respective limit switches, is to develop motor-reversing switching for the traverse-drive means 30, at each longitudinal end of the traverse cycle. The torch 20 thus shuttles back and forth continuously, over the span determined by setting of the limit-switch stops, and at a speed determined by adjustment at 31.

Torch ignition is effected by spark from an electrode 37 to the discharge end of nozzle 23. A standard oil-burner ignition circuit suffices to excite electrode 37 via its supply lead 37' for a relatively short-duration interval, with ample assurance of safe ignition of the torch. Electrode 37 is fixed in its spacing from nozzle 23, by means of an offset projection 38 forming part of the torch assembly.

The torch 20 further comprises an upstanding frame structure 39 which serves to position an inclined pipe 40 for the forward gravitational discharge of a flow of metal powder to the immediate vicinity of and above the discharge end of nozzle 23. As shown, a base 41 mounts to the frame structure 39 and removably accommodates two spaced supply bottles 42–43, each containing a different metal powder — e.g., a "bonding-metal powder" at 42 and an "overlay-metal powder" at 43. Passages within base 41 include separate valves, respectively controlled by actuators 44–45 to determine whether and which metal powder is to be allowed to flow in pipe 40 for external admixture with the torch flow.

The description of FIG. 1 is completed by briefly identifying instrumentation and controls at a panel 49, applied to a conveniently accessible surface of the console 11. And it is convenient in this connection to describe a full cycle of machine operation, assuming that the workpiece has been chucked and the machine fully set up and connected to its various supplies. A first push button 50 is operated to bring electric power to the control system (to be later described in detail in connection with FIG. 3); this fact is indicated by a lamp 51, which may be red. All is in readiness, and a push button 52 is operated to initiate automatic operation; specifically, the automatic traverse mechanism 30 and the circuit to igniter electrode 37 are both activated, and the operator starts the torch by opening valves 21'–22' in the gas supply lines 21–22. A second indicator lamp 53, which may be green, operates to show that automatic functions are proceeding, and a first timer begins to time-out the full period of torch operation; the timers and their settings are described later in connection with FIG. 3, but panel 49 includes three displays, at 54–55–56, for the set times of three different cycles.

The first timed cycle (shown at 54) involves operation of torch 20 solely for substrate-preheat purposes, and no metal powder is supplied; an indicator lamp 54' is lighted to indicate that the process is in this initial phase, which may be two, three or more minutes of continuously shuttled torch-discharge traverse of the workpiece region to be treated, the time depending upon the particular size, alloy or other character of the workpiece. At the end of this first timed cycle, a second timed cycle commences as a first valve actuator 44 is operated to open its associated powder-supply valve, allowing a flow of metal powder from supply 42 (e.g., a bonding-metal powder) to discharge via pipe 40 for admixture with torch flow. In the course of such mixing, the powder fragments are softened to droplets and are conveyed into contact with and adherence to the exposed rotating surface of the workpiece; and by reason of multiple traverses in the period of the second timed cycle, a circumferentially and axially continuous layer of uniform thickness of first metal is developed upon the workpiece. The preselected time of this second timed cycle is displayed at 55, and the operation of this second timed cycle is indicated by illumination of a lamp 55', the first-cycle lamp having been extinguished upon completion of the first timed cycle.

The third timed cycle proceeds as described for the second timed cycle, being automatically initiated upon timed-out completion of the second timed cycle. The predetermined interval of the third timed cycle is displayed at 56, and an associated lamp 56' is excited (to the exclusion of lamps 54'–55') to indicate that the third-cycle phase is operative. In transfer from the second timed cycle to the third timed cycle, valve actuator 45 is operated and valve actuator 44 is de-activated, causing a flow of metal powder from supply 43 (e.g., an overlay metal powder) to take the place of powder from supply 42, all as one continuous powder flow, and all without interruption of torch operation, or of torch-traverse shuttling, or of workpiece rotation. The third cycle timer will time out a sufficient desired deposit of overlay metal coat upon the workpiece, whereupon the actuator 45 is deactivated and all electric drives and controls are shut down, including gas supplies to lines 21–22, as will be explained in connection with FIG. 3, to shut down the torch 20. The completed workpiece may then be removed and replaced by a similar untreated one, for exactly duplicated operations upon and resultant coating of the new piece. And the reproduction of coatings can be assuredly faithful, from one piece to the next, as long as the supplies at 42–43 are monitored for sufficiency.

To complete the description of panel 49, a pilot lamp 57 is operative to indicate that no cycles are proceeding and provides the reassurance of certification that the succession of cycles has been completed. A large mushroom-type button 58, enables the operator in an emergency to shut off all electric power to the machine, and to otherwise automatically shut down the machine and its gas supplies. And a pressure indicator 59 and associated adjustable regulating valve means 60 enable monitoring of the correct air pressure for pneumatic operation of the valve actuators 44–45.

Figure 2:
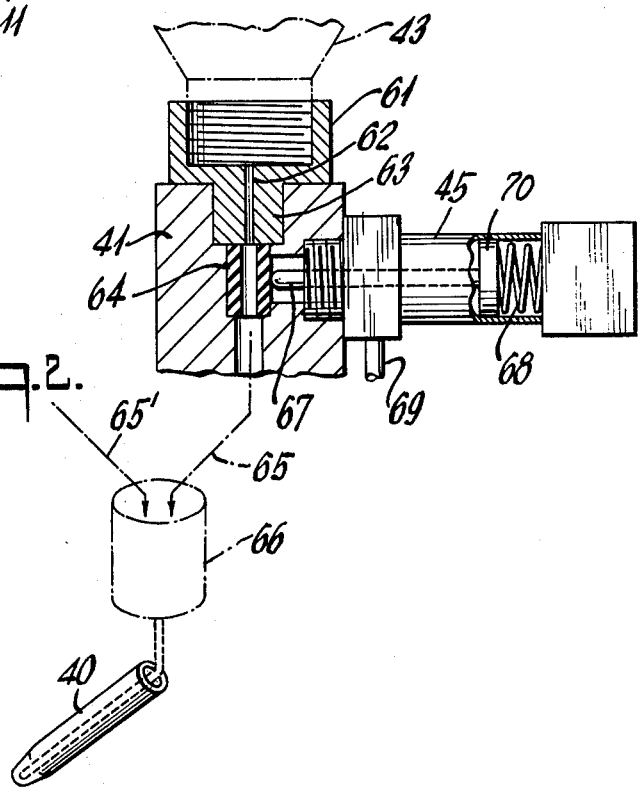
FIG. 2 is an enlarged, fragmentary diagram of metal-powder flow-control mechanism of FIG. 1.

FIG. 2 provides schematic illustration of the internal structure and functioning of the powder-supply and powder-flow control mechanism, detail being provided only for the case of supply 43 and for the overlay metal powder. As seen, the powder vessel 43 is threaded to an inverted cap 61 having a central aperture which communicates with an orifice passage 62 in an insert block 63, and thence with an elastomeric valve element or tube insert 64; inserts 63–64 are received in successive aligned counterbores in the base 41, and a flow of powder from supply 43 passes gravitationally through inserts 63–64 to an internal downwardly inclined passage 65 for communication with discharge tube 40, via a chamber 66. The base 41 will be understood similarly to accommodate the other powder supply 42 to a second downwardly inclined passage 65' which also communicates with discharge tube 40, via the chamber 66. The question of powder flow or not in either of passages 65–65' will depend upon whether the associated valve element (e.g., 64) has been actuated to open or to closed position. As shown, the actuator 45 for valve element 64 comprises a stem or ram 67 which is normally urged by spring means 68 to pinch off and thus close the passage via the elastomeric valve element 64; actuation to the valve-open position shown is by controlled application of pressurized air at an inlet 69 to the tail end of a piston 70 to which ram 67 is connected. A similar description applies for the other actuator 44, which is also pressure-actuated to valve-open position.

Figure 3A:
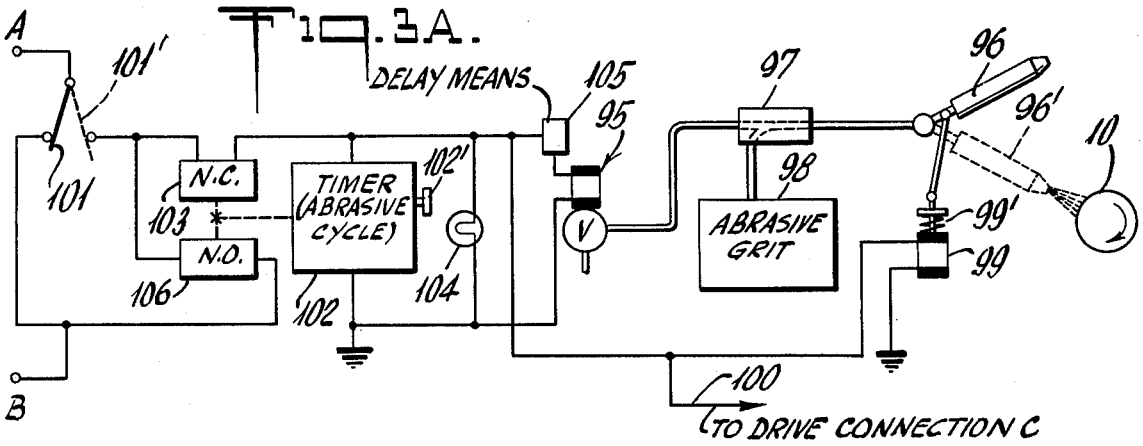
FIG. 3A is a similar diagram for optional additional circuitry.
Figure 3:
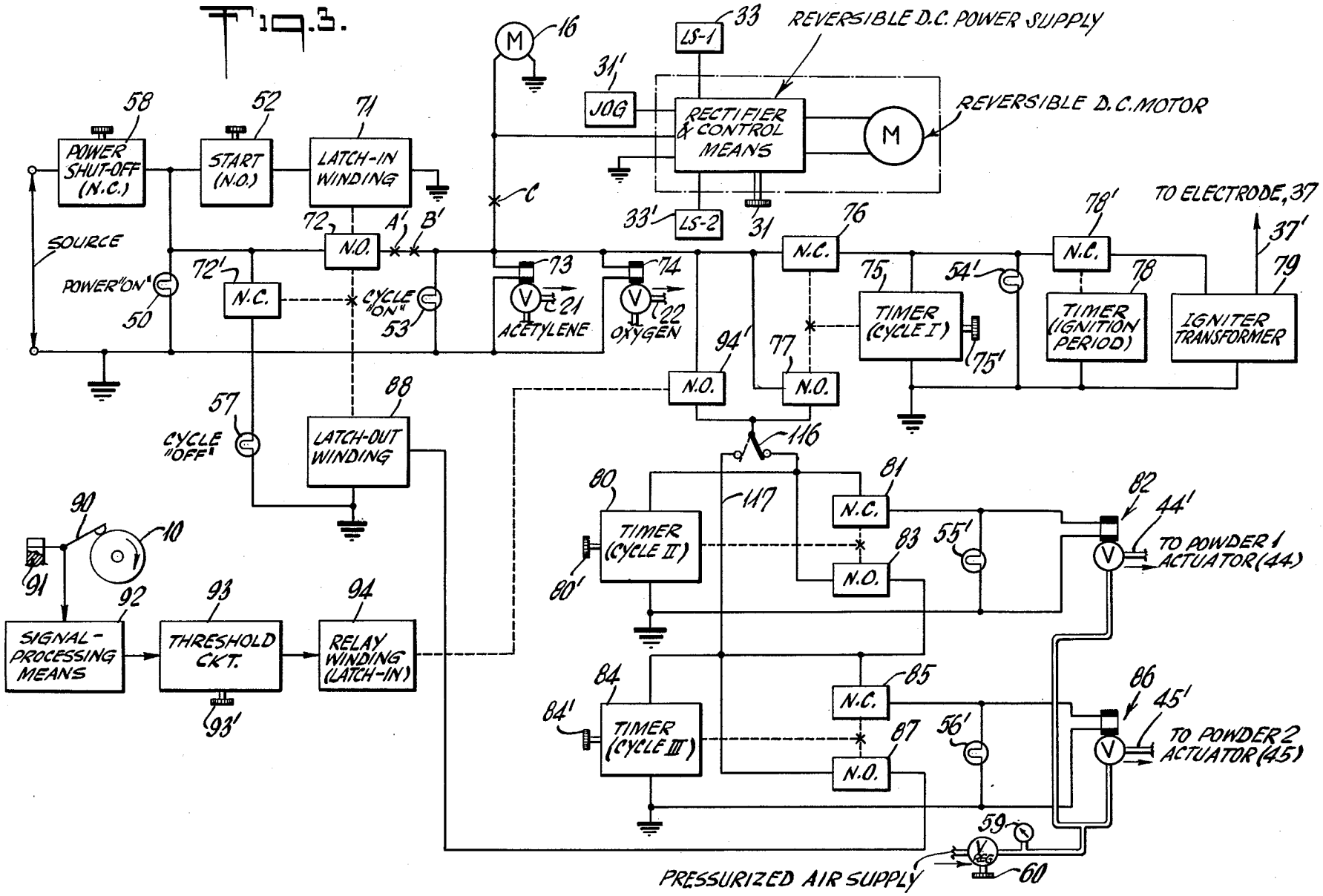
FIG. 3 is an electrical block diagram of circuitry to operate the machine of FIG. 1.

FIG. 3 provides additional detail for an understanding of coordinated automatic operation of the described machine, and for simplification all electrical return lines have been shown as grounded. The power shut-off button 58 has normally closed contacts, and therefore circuit connection to a source (indicated by legend) will immediately illuminate (a) the lamp 50, signifying "power on" to the machine, and (b) the lamp 57, signifying "cycle-off", meaning that no cycles are in progress. The push button 52 is pressed to close its normally open contacts to supply momentary excitation to a "latch-in" winding 71 having normally open contacts 72 which are thus closed to latch (e.g., magnetically retain) power to the automatic cycle-control system; normally closed contacts 72' to lamp 57 are also operated by winding 71. Thus connected (upon closure of contacts 72 and opening of contacts 72'), the "cycle-on" lamp 53 illuminates, the "cycle-off" lamp 57 extinguishes, and several parallel circuits are also simultaneously established, namely:

1. Starting of work-rotation motor 16;

2. Excitation of a reversible D.C. power supply, for control of a D.C. motor, already collectively identified as the self-propelling traverse drive means 30, having self-reversing limit-switch connections LS-1 (33) and LS-2 (33');

3. Solenoid actuation of valve means 73 to open position, governing admission of acetylene-gas supply to the torch line 21;

4. Solenoid actuation of valve means 74 to open position, governing admission of oxygen supply to the torch line 22;

5. Start of a Cycle-I timer 75, to time out its period, predetermined by adjustment at 75'; it being noted that timer 75 is provided with normally closed contacts 76 through which timer 75 is run, and with normally open contacts 77 which close upon completion of the Cycle-I timed interval (the work-preheat interval);

6. Illumination of the lamp 54', to visually indicate the fact of Cycle-I operation;

7. Start of a second timer 78 via its normally closed contacts 78' to govern a period of electrode (37) sparking to nozzle 23; and 8. Excitation of an igniter transformer 79 having its secondary connected via line 37' to electrode 37. A short period, in the order of ten seconds, is more than ample for ignition time at 78, the same being disconnected at 78' upon lapse of the ignition-time interval.

When the predetermined Cycle-I or preheat interval has been timed out, the normally closed contacts 76 open, to extinguish the Cycle-I indicator lamp 54', and to allow the ignition circuitry to reset. At the same time, normally open contacts 77 close to initiate and maintain excitation to a Cycle-II timer 80 (via the solid-line position of a selector switch 116, to be later described), for a Cycle-II duration preselected at 80'. A circuit is thus made, via normally closed contacts 81 of timer 80, to Cycle-II parallel circuits, namely:

1. To illuminate the Cycle-II indicator lamp 55'; and

2. To operate a solenoid valve 82 which governs supply of pressurized air from a suitable source (not shown) to line 44' to the pnuematic actuator 44 for opening powder flow (to discharge pipe 40) from the first-powder supply 42.

When the predetermined Cycle-II or bond-coat interval has been timed out, the normally closed contacts 81 open, to extinguish the Cycle-II indicator lamp 55', and to shut off the flow of powder from the first-powder supply 42. At the same time, normally open contacts 83 close, to initiate and maintain excitation to a Cycle-III timer 84, for a Cycle-III duration preselected at 84'. A circuit is thus made, via normally closed contacts 85 of timer 84, to Cycle-III parallel circuits, namely:

1. To illuminate a Cycle-III indicator lamp 56'; and

2. To operate a solenoid valve 86 which governs supply of pressurized air from the pressurized-air source to line 45' to the pneumatic actuator 45 for opening powder flow (to discharge pipe 40) from the second-powder supply 43.

When the predetermined Cycle-III or overlay-coat interval has been timed out, the normally closed contacts 85 open, to extinguish the Cycle-III indicator lamp 56', and to shut off the flow of powder from the second-powder supply 43. At the same time, normally open contacts 87 close to complete a circuit to a "latch-out" winding 88 associated with contacts 72, thereby resetting the latter to their normally open condition and shutting down all machine operations, including workpiece rotation, torch traverse, powder flow and torch-gas supply. At this point, the workpiece is complete and may be removed from chuck 14, for replacement with the next workpiece and for an exact repeat of the described operations.

Before proceeding with further discussion, it should be noted that the described machine lends itself to one or more test operations on a single workpiece wherein, for example, the workpiece is continuously rotated but different combinations of bondcoat (first powder) and overlay coat (second powder) are applied to the same workpiece at different axially spaced regions of the same. For this purpose, the shuttle cycle of traverse drive is dispensed with and a push-button operated "jog" control 31' of means 30 merely axially displaces the torch from the axial region of a first test-coat application, to the axial region of a second test-coat application. In each case, the described automatic cycle of start-up, preheat, bond coat, and overlay coat, and shut down is performed without traverse, but at whatever changed setting or settings may be deemed appropriate at 75', 80', 84'; of course, without a traverse, all times set at 75', 80', 84' will be different from those applicable to a traversed situation, but as to powder application, the proportions of total powder-flow time controlled at 44–45 will be the same, as between a non-traversing and a traversing situation, producing coat combinations of substantially equivalent nature, the only significant difference being as to axial extent of the coating.

Thus far, Cycle I has been described as a timed cycle. For production work, this will generally suffice because, from one workpiece to the next, the required amount of preheat for each piece will be substantially identical. However, if successive workpieces are chucked at different temperatures, and particularly if plural test-sample coats are to be applied to axial spacings on the same workpiece, the requisite preheat time may be different, from one coating operation to the next. To address this situation, FIG. 3 additionally shows a temperature or heat-sensitive probe 90 having a frame-fixed mounting 91 and continuously tracking the backside of the workpiece surface, preferably at a location axially offset to one side of the axial span of torch traverse or of axial position of the torch. The probe 90 is electrically connected to suitable signal-processing means 92, producing an output to a threshold circuit 93, having a setting predetermined by selection at 93'. When the thus-tracked heat signal achieves the predetermined threshold level, circuit 93 is operative upon a relay winding 94 having associated normally open contacts 94' connected in parallel with the normally open contacts 77 of the Cycle-I timer 75. Thus, if means 90–92–93–94 has detected achievement of the desired preheated condition of the workpiece before the Cycle-I period has been timed out, the normally open contacts 94' will be operative to transfer torch 20 to its first or bondcoat spraying phase, with timing determined by means 80 already described.

The foregoing discussion of my machine and process has assumed proper initial preparation of the workpiece surface, for reception of its sprayed-metal coating. A satisfactory preparation may involve turning the surface in a lathe, in a single fast traverse of shallow rough cut, to produce a shallow relatively rough-textured helical groove in the surface; generally speaking, a V-groove, of 1-mm advance per turn, approximately 90° V-angle and about 0.2 to 0.3-mm depth, provides a satisfactory base for sprayed-metal coating with my machine. Alternatively, satisfactory bonding is also achievable using an abrasive-grit blasting treatment of the surface to be coated. My machine lends itself to automated application of such abraded-surface pretreatment of the workpiece, and FIG. 3A schematically shows optional mechanism and circuitry for the purpose.

Briefly, a solenoid valve 95 is actuated to deliver pressurized air to nozzle structure 96 that is movably mounted about a swivel axis that is fixed to the traverse carriage 27. The air line which connects valve 95 to nozzle 96 includes a fitting 97 for the aspirated induction of abrasive grit from a supply 98 and into the flow of blast air. The normal position of nozzle 96 is shown in solid outline, being elevated well out of the region of workpiece 10, and when depressed for use (phantom outline 96') the grit-blast delivery is directed at and close to the workpiece surface. A solenoid 99 is shown to actuate nozzle 96 to its depressed and operative position, and a spring 99' is relied upon to retract nozzle 96 (out of the way of the torch discharge) after its cycle of abrasive blasting. Preferably, work rotation and the described automatic traverse shuttling of carriage 27 are operative during the blasting cycle.

The blasting circuit of FIG. 3A is drawn for insertion of terminals A–B thereof in series with the output line connection of the normally closed contacts 72 of FIG. 3. To make this insertion, the output line from contacts 72 is severed, thus establishing line ends A'–B' to which the terminals A–B are respectively connected; and an additional drive-control line connection 100 is made from the circuit of FIG. 3A to point C in the drive-control line 100' of FIG. 3.

As shown, the circuit of FIG. 3A includes at its input a selector switch 101 by means of which points A'–B' of FIG. 3 can be directly connected so that the successive preheat and metal-spraying operations can proceed (without blasting), all as previously described. However, upon actuating switch 101 to its blast-selecting position (phantom outline 101'), the blasting cycle is caused to take place before the other described operations. Thus, upon a "start" actuation of means 52 and with switch 101 in its blast-selecting position, closure of contacts 72 activates an abrasive-cycle timer 102 via its normally closed contacts 103, the time period of the blasting cycle having been predetermined by adjustment at 102°. An excitation circuit is thus simultaneously made for the duration of the timing interval for timer 102, to plural blasting-cycle circuits, namely:

1. To illuminate a blasting-cycle lamp 104;
2. To excite line 100, with its connection C to the work-rotating and traverse-shuttle drives of FIG. 5;
3. To operate solenoid 99 for actuating nozzle 96 to its blast position (96');
4. To operate solenoid 95 for delivery of blast air with aspirated abrasive grit to nozzle 96, delay means 105 being serially provided in the excitation connection to solenoid 95 so that abrasive grit will not be delivered until work rotation and traverse functions have commenced or until the nozzle has been displaced to its blasting position.

When the predetermined blast-cycle interval has been timed out, the normally closed contacts 103 open, to cut off all described blast functions. At the same time, normally open contacts 106 of timer 102 are closed, to complete the circuit connections between points A–B, thus reconditioning FIG. 3 circuitry to the Cycle-I (preheat) connections already described. Operation proceeds thereafter to completed metal coating of the workpiece 10, in an automatic sequence which has also already been described, and there will have been no interruption of either workpiece rotation or continuous shuttling of the traverse carriage 27.

Figure 4:
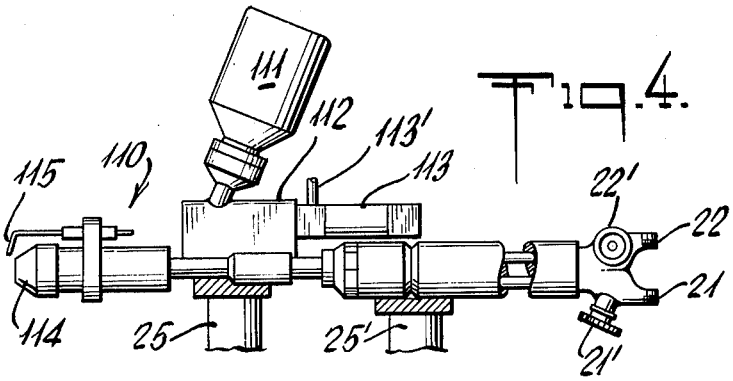
FIG. 4 is a view in side elevation of a different-type torch for optional alternative use in the machine of FIG. 1.

FIG. 4 illustrates an alternative employment in my machine of torch structure 110 which is characterized by internal admixture of a metal powder flow into the torch-gas flow, prior to ignition. Torch parts per se, particularly at powder-gas mixing, are generally as shown in Schilling U.S. Pat. No. 3,226,028 and therefore need not now be described in detail. Briefly, the torch 110 is elongate and is mounted to the pedestals 25–25' already described. It is supplied by gas at line connections 21–22, and a flow of metal powder from an inverted supply bottle 111 is passed to the torch-gas flow via a valve body 112, when an actuator 113 is operated to valve-open condition. Actuator 113 may be air-pressure operated, via inlet 113', as described for actuator 45 in FIG. 2, and the valve member in body 112 may also be as described at 64–67 in FIG. 2. At its front or discharge end, torch 110 includes a nozzle 114 and an igniter electrode 115, carried and supplied as previously described. Operation with the torch of FIG. 4 can proceed automatically using control circuitry of FIG. 3, except that for the single powder supply down at 111, there is need for but a single spray timer. Thus, it will be understood that for such operation, the functions of the Cycle-II timer 80 of FIG. 3 may be effectively by-passed, by shifting a selector switch 116 from its Cycle-II timing position (solid-line position) to its Cycle-II by-passing position (dashed-line position). In the latter position of switch 116, closure of either of the normally open contacts 94'–77 will be ineffective to excite the Cycle-II timer 80 but will carry line excitation directly via line 117 to the Cycle-III timer 84, whereupon automatic operation proceeds to completion in the manner already described.

Figure 5:
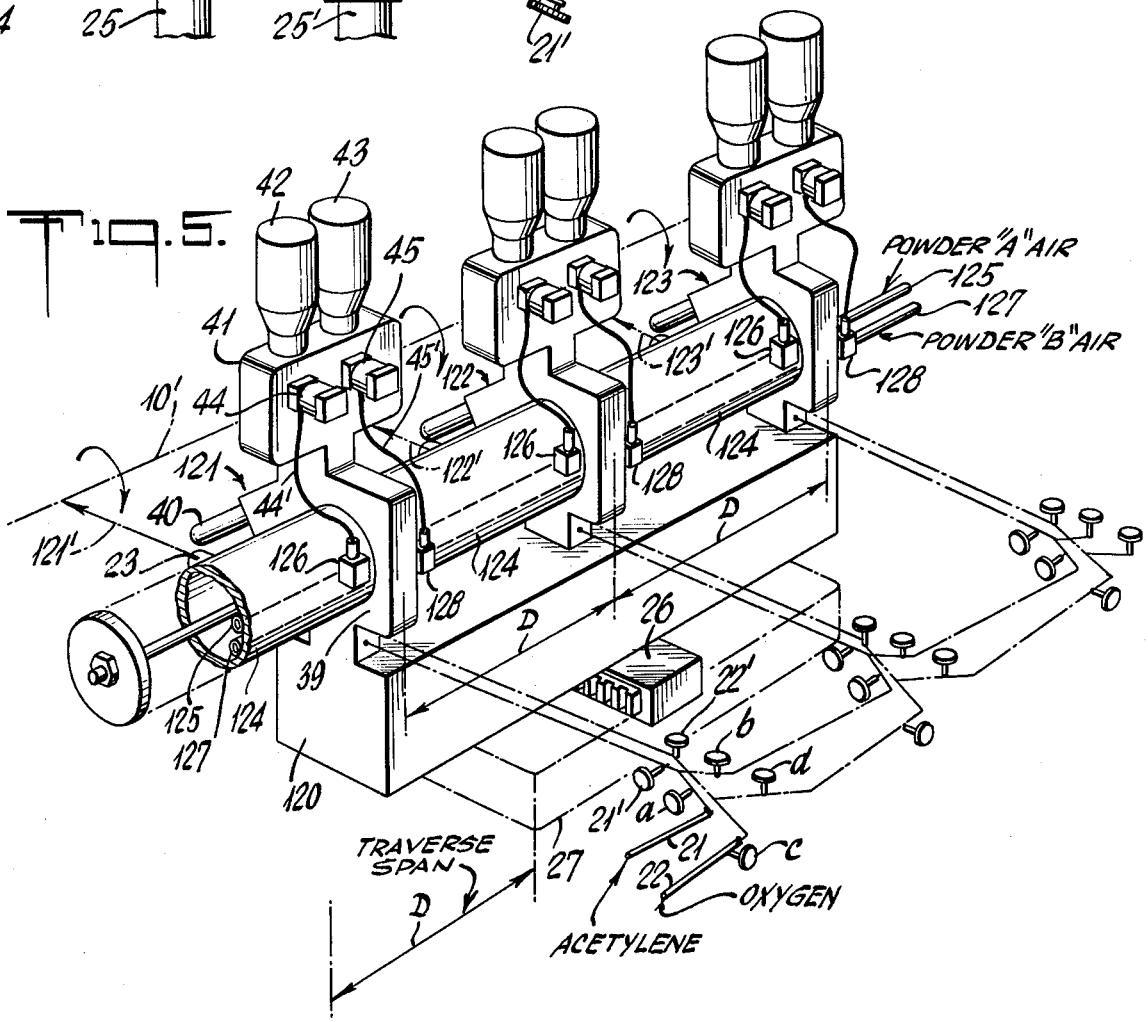
FIG. 5 is a fragmentary view in perspective to show further alternative torch structure.

FIG. 5 is a fragmentary view in perspective to show multiple torch structure mounted to an elongate base 120 effectively forming part of the cross slide 26. The individual torch assemblies 121–122–123 will be recognized as essentially duplicates of the torch 20 of FIG. 1, being clamped by a central tie rod and spaced by tubular members 124 so as to establish equal axial spacings D between nozzle-discharge axes 121'–122'–123', each of which is oriented normal to the axis 10' of workpiece rotation. Each torch is equipped with dual powder supplies as already described, and therefore identifying numbers of FIG. 1 have been applied primarily to the torch 121 in FIG. 5. Pressurized air for operating the first-powder ("A" powder) actuators 44 of all torches is supplied by a first manifolding line or header 125 within the aligned tubular spacers 124, individual pick-off lines 44' being served via connector fittings 126 to line 125. Similar but separate supply of pressurized air for operating the second-powder ("B" powder) actuators 45 of all torches is via a second manifolding line 127 within spacers 124 and adjacent line 125, individual pick-off lines 45' being served by connector fittings 128 to line 127. Gas supplies to all torches are also in parallel from lines 21–22, with liberal provision of stop valves, as at *a–b* on both sides of the line 21 (acetylene) connection to valve 21', and as at *c–d* on both sides of the line 22 (oxygen) connection to valve 22'. Such liberal provision of stop valves will be understood to permit ready and safe adaptation of the described multiple-torch assembly to other multiple-torch arrangements, with minimum down-time.

The multiple-torch configuration of FIG. 5 will be understood to be applicable to larger or more elongate workpieces than as described for FIG. 1. Briefly, the workpiece 10 of FIG. 1 is small enough to accept and retain its desired preheat level throughout the bonding and overlay cycles; for example, a 6-inch length of 2-inch diameter rod represents a workpiece which is readily accommodated by the single-torch machine of FIG. 1. On the other hand, a 6-inch diameter workpiece which must receive a metal coating that is of axial extent many times its diameter, for example for an axial extent of three feet, is better served by the multiple-torch embodiment of FIG. 5. In the latter event, for a three-torch arrangement as shown, torches 121–122–123 are set up with a spacing D of one foot, and limit-switch abutments 34–35 (FIG. 1) are also set for a traverse-shuttle span of the same extent D. Thus, torches 121–122–123 will each account for the preheat, bonding-coat and overlay-coat cycles for adjacent one-foot lengths of the full three feet to be coated. In practice, I have achieved highly effective metal coatings in this segmented manner, with full continuity of bonding and overlay layers, even at the region of adjacency of coverage by adjacent torches. In other words, the bonding coat is for all intents and purposes axially as well as circumferentially continuous as is also the overlay coat, both for the combined axial-treatment capability of all torches.

In the present context, the expression "bonding-metal powder" has reference to a spray powder for producing an adherent foundation layer on a metal substrate by means of which an overlay of another metal is bonded adherently to said substrate.

A preferred bonding-metal powder is one in which each particle is an agglomerate of nickel and aluminum particles held together by a binding resin comprising 3 to 15 percent by weight of aluminum and the balance essentially nickel. The amount of binding resin may range from about 1 to 5 percent by weight of the total mixture. The agglomerates are produced using a fugitive binding agent, e.g., a decomposable organic binding agent, such as a phenolic or other similar resin. Such resins adhesively bond the ingredients together.

The average size of the agglomerate ranges from about minus 100 mesh to plus 325 mesh and, more preferably, from about minus 140 mesh to plus 325 mesh. In spraying the bond coat powder onto the prepared metal substrate, the aluminum in the agglomerate oxidizes in the flame to provide exothermic heat of oxidation which raises the temperature of the flame and provides a means of producing an adherent bond coat on the metal substrate to which the final coating strongly adheres. The bond coat may range in thickness from 0.002-inch to 0.01-inch.

The expression "overlay of metal" has reference to the top coat applied to the previously applied bond coat and generally comprises self-fluxing nickel-base, cobalt-base, iron-base and copper-base alloys. The self-fluxing properties are due to the presence of silicon and boron in the "overlay-metal powder".

As regards the self-fluxing nickel-base, cobalt-base and iron-base alloys, the alloys generally contain by weight about 0.05 percent to 6 percent Si, about 0.5 percent to 5 percent B and up to about 3 percent C, the balance being essentially either nickel, or cobalt, or iron together with alloying elements, such as Cr, W and Mo.

A typical Ni-base alloy may contain by weight about 0.5 percent to 3 percent Si, about 1 percent to 5 percent B, 0 to about 3 percent C, about 5 percent to 25 percent Cr, 0 to 15 percent Mo, 0 to 15 percent W and the balance essentially nickel, the total Cr + Mo + W content ranging up to about 30 percent.

A typical cobalt-base alloy may range in composition by weight from about 0.5 percent to 3.5 percent Si, about 1 percent to 3 percent B, 0 to about 3 percent C, about 5 percent to 30 percent Cr, 0 to about 15 percent Mo, 0 to about 15 percent W and the balance essentially cobalt, the total Cr + Mo + W content ranging up to about 30 percent.

The iron-base alloy may range in composition by weight from about 0.5 percent to 3 percent Si, about 1 percent to 3 percent B, 0 to about 3 percent C, about 5 percent to 25 percent Cr, 0 to about 15 percent Mo, 0 to about 15 percent W and the balance essentially iron, the total Cr + Mo + W content ranging up to about 30 percent.

The top or overlay-coat alloys are formulated to provide melting points ranging up to about 2500° F (1371° C), the melting points ranging from about 1800° F (983° C) to 2250° F (1233° C). The melting point is controlled by the amount of silicon and boron in the alloy. The coating is applied by flame spraying an alloy powder of the composition (e.g. atomized powder). The alloy-powder particle can be of a mesh size ranging from less than 125 mesh (about 125 microns) to about 400 mesh size (about 40 microns). Mesh size referred to herein based on U.S. Standard.

The top or overlay coat may range in thickness from about 0.005-inch to 0.2-inch.

For flame-spraying situations in which metal-powder flow is internally admixed with the torch-gas flow, as in FIG. 4, it is not desirable to employ exothermic material in a bonding coat and therefore reliance must be placed upon the overlay coat to sufficiently adhere the coating to the substrate. Generally, the above-indicated overlay materials are satisfactory in the internally mixed situation of FIG. 4. As between external and internal mixture of metal powder, I certainly prefer the external supply situation of FIGS. 1 and 5 because of the exothermic ingredients which can be safely employed. And the torch concept of copending application, Ser. No. 643,823, filed Dec. 23, 1975 (now U.S. Pat. No. 3,986,668), can be utilized advantageously where it may be desired to employ a quasi-external (quasi-internal) feed of an exothermic bonding-metal powder and internal feed of an overlay-metal powder.

It will be seen that I have described means and methods which meet all stated objects. My invention brings an individual art form to a predictable level of high performance and product, to the extent that far less operator skill is required, wastage of materials is materially reduced, and production capabilities greatly enhanced.

In all cases, whether using single or multiple torches, the grooves or other discontinuities produced by the indicated pretreatment of the workpiece surface are completely filled and uniformly covered by the sprayed metal powder or powders, with a bonding efficacy which is not only superior but also reproducibly superior.

To illustrate the efficacy of the invention, I provide below two specific examples of automated coating, using the embodiments of FIGS. 1 and 5, respectively:

EXAMPLE I (FIG. 1 Embodiment)

| | |
|---|---|
| Workpiece: | 2-inch diameter, by 8-inch length, 1020 steel, chucked for coating 3-inch to end. |
| Traverse Span: | 3-inches. |
| Traverse Cycle: | 10 cycles per minute. |
| Distance, nozzle to work surface: | 8-inches. |
| Work-Rotation Speed: | 100 RPM. |
| Total-Cycles Time: | About 7 minutes. |
| Preheat Timer, Cycle-I: | 3 minutes (room temperature to 200° F). |
| Bonding-Coat Timer, Cycle-II: | 1 minute. |
| Overlay-Coat Timer, Cycle-III: | 3 minutes. |
| Bonding Powder, at 42: | "XUPERBOND"*; about 1-ounce consumed; bonding-layer thickness of 0.001-inch. |
| Overlay Powder, at 43: | "LUBROTEC 19985"*; about 8-ounces consumed; overlay-layer thickness of about 0.008-inch. |

*Trademarks of Eutectic Corporation, New York, New York, for its exothermic bonding powder and for its machinable final-coat (overlay) powder.

REMARKS: Longitudinal cut of coated workpiece (in plane of rotation axis) showed uniformly thick bonding coats and overlay coats along diametral ends of the coat, over the entire specified three inches of desired coating, within ten percent of stated thicknesses; radial-plane cuts of coated workpiece, at central and outer ends of the 3-inch desired coating region showed circumferentially uniform bonding coat and overlay coat, within ten percent of stated thicknesses.

EXAMPLE II (FIG. 5 Embodiment

| | |
|---|---|
| Workpiece: | 6-inch diameter, by 8-ft. length, 1020 steel, chucked for coating 2-ft. central - span region. |
| Traverse Span: | 8-inches. |
| Traverse Cycle: | 10 cycles per minute. |
| Number of Torches: | Three, at 8-inch axis spacings. |
| Distance, nozzle to workpiece: | 8-inches. |
| Work-Rotation Speed: | 100 RPM. |
| Total-Cycles Time: | 28 minutes. |
| Preheat Timer, Cycle-I: | 15 minutes. |
| Bonding-Coat Timer, Cycle-II: | 3 minutes |
| Overlay-Coat Timer, Cycle-III: | 10 minutes. |
| Bonding Powder, at 42, for all torches: | "XUPERBOND"; about 4-ounces; bonding layer thicknesses of about 0.002-inch. |
| Overlay Powder, at 43, for all torches: | "LUBROTEC 19985"; about 6-lbs., overlay-layer thicknesses of about 0.030-inch. |

REMARKS: Coatings are uniform, even at adjacency of traverses of adjacent torches.

While the invention has been described in detail for preferred embodiments, it will be understood that modifications may be made without departing from the scope of the invention.

What is claimed is:

1. An automatic machine for applying metal coating to a generally cylindrical metal substrate, comprising a frame including work-holding means supported for rotation about an axis that is fixed with respect to said frame, drive means for rotating said work-holding means, a gas torch for operating upon work supported by said work-holding means, a carriage mounting said torch in position for discharge upon a local region of the supported work, guide means coacting between said carriage and frame for longitudinally guided traverse of said torch with respect to the work, recycling reciprocating drive means for imparting a predetermined repetitive traverse of the work by said torch; said torch comprising a discharge nozzle and means including a gas-flow valve for on-off supply of a gas flow to said nozzle, ignition means positioned adjacent said nozzle for igniting a gas-supplied nozzle discharge, spray-powder supply means, and means including a powder-flow valve for on-off control of a flow of spray powder for admixture with torch flow; and control means operative upon said reciprocating drive means and upon said respective valves and determining (a) a period of torch-reciprocation cycles while said powder-supply valve is in "off" condition, followed (b) by a period of torch-reciprocation cycles while said powder-supply valve is in "on" condition, said control means further determining an "on" condition of said gas-flow valve for at least the combined total of said periods.

2. The machine of claim 1, in which said spray-powder supply means is one of two which are similarly connected for admixture with torch flow.

3. The machine of claim 2, in which said control means determines (c) a first predetermined period of torch-reciprocation cycles during which one of the powder-supply valves is "on" to the exclusion of the other, followed (d) by a second predetermined period of torch-reciprocation cycles during which the other of the powder-supply valves is "on" to the exclusion of said one.

4. The machine of claim 2, in which each of said spray-powder supply means includes its own powder-flow valve, and conduit means connected to the outlets of both powder-flow valves and including a single powder-flow conduit for powder flow admixture with torch flow.

5. The machine of claim 1, in which said drive means for said work-holding means includes selectively operable means for determining work-rotational speed.

6. The machine of claim 1, in which said traverse guide means includes selectively operable means for determining the effective extent of the cycle of longitudinal traverse.

7. The machine of claim 1, in which said traverse guide means includes selectively operable means for determining the effective extent of the speed of longitudinal traverse.

8. The machine of claim 1, in which said carriage includes a cross slide for mounting said torch, and selectively operable means for positioning said cross slide.

9. The machine of claim 1, in which said control means includes selectively operable means for predetermining selected times for said periods.

10. The machine of claim 1, in which heat-sensing means carried by said frame is positioned for local response to the currently heated condition of work supported by said work-holding means, said control means including means responsive to a predetermined threshold of response by said heat-sensing means for controlling operation of said powder-flow valve from "off" to "on" condition.

11. The machine of claim 1, in which said torch includes a passage for gas flow from said gas-flow valve to said nozzle, and in which spray-powder supply means is connected to said passage, whereby powder admixture with torch flow is internal.

12. The machine of claim 1, in which said spray-powder supply means includes a discharge conduit connected to the outlet of said powder-flow valve, said conduit being positioned for discharge into the nozzle-discharge flow at a location external to said nozzle, whereby powder admixture with torch flow is external.

13. The machine of claim 12, in which said powder-flow valve comprises an elastomeric conduit element at the supply end of said discharge conduit, resiliently loaded pinch mechanism operative upon said elastomeric element to normally close said conduit, and pressure-operated means for actuating said pinch mechanism to effectively open said conduit.

14. The machine of claim 12, in which said powder-flow valve comprises an elastomeric conduit element at the supply end of said discharge conduit, resiliently loaded pinch mechanism operative upon said elastomeric element to normally close said conduit, and solenoid-operated means for actuating said pinch mechanism to effectively open said conduit.

15. The machine of claim 1, in which said torch is one of a plurality of similar gas torches mounted upon said carriage in spaced array.

16. The machine of claim 15, in which for each of said torches, said spray-powder means is one of two which are similarly connected for admixture with the associated torch flow.

17. As an article of manufacture, a torch-traverse carriage including reversible self-propulsion mechanism for recycled reciprocating shuttle displacement of said carriage between predetermined limits, a gas torch mounted upon said carriage and including a discharge nozzle with its discharge axis oriented generally transverse to the path of shuttle displacement of said carriage, said torch including a gas-flow valve for on-off supply of a gas flow to said nozzle, ignition means positioned adjacent said nozzle for igniting a gas-supplied nozzle discharge, spray-powder supply means and means including a powder-flow valve for on-off control of a flow of spray powder for admixture with torch flow, and a control means operative upon said propulsion mechanism and upon said respective valves and determining (a) a period of torch-reciprocation cycles while said powder-supply valve is in "off" condition, followed (b) by a period of torch-reciprocation cycles while said powder-supply valve is in "on" condition, said control means further determining an "on" condition of said gas-flow valve for at least the combined total of said periods.

18. The article of claim 17, for use wherein shuttle displacement of said carriage is in a generally horizontal plane, said spray-powder supply means being positioned at an elevation above that of said nozzle, and said spray-powder supply means including a gravity-operated discharge conduit connected to the outlet of said powder-flow valve and positioned for discharge into the nozzle-discharge flow at a location external to said nozzle.

19. As an article of manufacture, a combined heat-treating and metal-spraying device, comprising a gas torch including a body with a discharge nozzle, a gas-flow valve carried by said body for on-off supply of a gas flow to said nozzle, spray-powder supply means carried by said body and including a powder-flow valve for on-off control of a flow of spray powder for admixture with torch flow, and control means operative upon said respective valves, said control means including a time-delay interlock between an opening of said gas-flow valve and an opening of said powder-flow valve, said powder-flow valve being open only while said gas-flow valve is open, and means controlling closure of said powder-flow valve when said gas-flow valve is closed.

20. As an article of manufacture, a combined heat-treating and metal-spraying device, comprising a gas torch including a body with a discharge nozzle, a gas-flow valve carried by said body for on-off supply of a gas flow to said nozzle, spray-powder supply means carried by said body and including a powder-flow valve for on-off control of a flow of spray powder for admixture with torch flow, and control means operative upon said respective valves, said control means including heat-sensing means carried by said body and directionally aligned for response to a work-heat condition in the general vicinity of torch operation upon a workpiece, said control means further including means responsive to a predetermined threshold of response by said heat-sensing means for controlling operation of said powder-flow valve from closed to open condition and only while said gas-flow valve is open, and means controlling closure of said powder-flow valve when said gas-flow valve is closed.

21. An automatic machine for applying metal coating to a generally cylindrical metal substrate, comprising a frame including work-holding means supported for rotation about an axis that is fixed with respect to said frame, drive means for rotating said work-holding means, a gas torch for operating upon work supported by said work-holding means, a carriage mounting said torch in position for discharge upon a local region of the supported work, guide means coacting between said carriage and frame for longitudinally guided traverse of said torch with respect to the work, recycling reciprocating drive means for imparting a predetermined repetitive traverse of the work by said torch; said torch comprising a discharge nozzle and means including a gas-flow valve for on-off supply of a gas flow to said nozzle, spray-powder supply means, and means including a powder-flow valve for on-off control of a flow of spray powder for admixture with torch flow; and control means operative upon said reciprocating drive means and upon said respective valves and determining (a) a period of torch-reciprocation cycles while said powder-supply valve is in "off" condition, followed (b) by a period of torch-reciprocation cycles while said powder-supply valve is in "on" condition, said control means further determining an "on" condition of said gas-flow valve for at least the combined total of said periods; said torch further comprising electric-ignition means including an electrode poised to spark at the region of nozzle discharge, and means synchronized with operation of said gas-flow valve to "on" condition for operating said ignition means.

22. The machine of claim 21, in which said last-defined means is operative to time the operation of said ignition means for a relatively short fraction of said first-mentioned period.

23. An automatic machine for applying metal coating to a generally cylindrical metal substrate, comprising a frame including work-holding means supported for rotation about an axis that is fixed with respect to said frame, drive means for rotating said work-holding means, a gas torch for operating upon work supported by said work-holding means, a carriage mounting said torch in position for discharge upon a local region of the supported work, guide means coacting between said carriage and frame for longitudinally guided traverse of said torch with respect to the work, recycling reciprocating drive means for imparting a predetermined repetitive traverse of the work by said torch; said torch comprising a discharge nozzle and means including a gas-flow valve for on-off supply of a gas flow to said nozzle, spray-powder supply means, and means including a powder-flow valve for on-off control of a flow of spray powder for admixture with torch flow, said spray-powder supply means being one of two which are similarly connected for admixture with torch flow; and control means operative upon said reciprocating drive means and upon said respective valves and determining (a) a period of torch-reciprocation cycles while said powder-supply valve is in "off" condition, followed (b) by a period of torch-reciprocation cycles while said powder-supply valve is in "on" condition, said control means further determining an "on" condition of said gas-flow valve for at least the combined total of said periods, and said control means also determining (c) a first predetermined period of torch-reciprocation cycles during which one of the powder-supply valves is "on" to the exclusion of the other, followed (d) by a second predetermined period of torch-reciprocation cycles during which the other of the powder-supply valves is "on" to the exclusion of said one; and selectively operable means for predetermining selection of a time period for operation of one powder-supply valve independently of the selection of a time period for operation of the other powder-supply valve.

24. An automatic machine for applying metal coating to a generally cylindrical metal substrate, comprising a frame including work-holding means supported for rotation about an axis that is fixed with respect to said frame, drive means for rotating said work-holding means, a gas torch for operating upon work supported by said work-holding means, a carriage mounting said torch in position for discharge upon a local region of the supported work, guide means coacting between said carriage and frame for longitudinally guided traverse of said torch with respect to the work, recycling reciprocating drive means for imparting a predetermined repetitive traverse of the work by said torch; said torch comprising a discharge nozzle and means including a gas-flow valve for on-off supply of a gas flow to said nozzle, spray-powder supply means, and means including a powder-flow valve for on-off control of a flow of spray powder for admixture with torch flow; control means operative upon said reciprocating drive means and upon said respective valves and determining (a) a period of torch-reciprocation cycles while said powder-supply valve is in "off" condition, followed (b) by a period of torch-reciprocation cycles while said power-supply valve is in "on" condition, said control means further determining an "on" condition of said gas-flow valve for at least the combined total of said periods; and directionally operative grit-blasting means mounted to said carriage in laterally offset relation to said torch and directionally aligned for work impingement at the general area of torch-discharge work alignment, said blasting means including means for activating and deactivating the same, said control means determining a timed preliminary period of torch-reciprocation cycles during which said blasting means is in activated condition prior to controlled initial actuation of said gas-flow valve to "on" condition.

* * * * *